United States Patent [19]

Baumann

[11] Patent Number: 4,729,427

[45] Date of Patent: Mar. 8, 1988

[54] HEAT EXCHANGER

[75] Inventor: Dieter Baumann, Greven-Gimbte, Fed. Rep. of Germany

[73] Assignee: Ing. Walter Hengst GmbH & Co. KG, Münster, Fed. Rep. of Germany

[21] Appl. No.: 41,780

[22] Filed: Apr. 23, 1987

[51] Int. Cl.[4] ..... F28D 7/02

[52] U.S. Cl. ..... 165/165; 165/72; 165/145

[58] Field of Search ..... 165/165, 72, 145

[56] References Cited

U.S. PATENT DOCUMENTS

| | | | |
|---|---|---|---|
| 3,161,234 | 12/1964 | Rannenberg | 165/165 X |
| 3,552,488 | 1/1971 | Grill et al. | 165/166 |
| 3,805,889 | 4/1974 | Coolidge | 165/166 X |
| 4,040,804 | 8/1977 | Harrison | 165/165 X |
| 4,556,105 | 12/1985 | Boner | 165/165 |

FOREIGN PATENT DOCUMENTS 3510441 10/1986 Fed. Rep. of Germany .

*Primary Examiner*—Albert W. Davis, Jr.
*Assistant Examiner*—Richard R. Cole
*Attorney, Agent, or Firm*—Felfe & Lynch

[57] ABSTRACT

A heat exchanger for two fluids, especially an oil cooler for oil and water in an internal combustion engine. The heat exchanger is made up of a dividing wall having a meander-like cross section which is bounded by two side covers to form longitudinal channels and having a headering system comprising cross channels, connecting channels, feed channels, and inlet and outlet openings located at each end of the heat exchanger. The heat exchanger is of modular design so that it can be easily expanded by the connection of several heat exchanger units.

14 Claims, 8 Drawing Figures

HEAT EXCHANGER

BACKGROUND OF THE INVENTION

The invention relates to a heat exchanger for two fluids, especially an oil cooler. The heat exchanger according to an earlier proposal of the Applicant (German Patent Application, German Patent Office Case No. P 35 10 441.4-16), which is the point of departure herein, serves especially as a substitute for an oil pan for a motor vehicle and it is especially adapted accordingly. All of the inlet and outlet openings are on one longitudinal side with a shortened cover and in various connection levels. Such a heat exchanger can be used only for special applications, and, for example, cannot easily be expanded by coupling a plurality of heat exchanger units to it, without occupying an excessive amount of space.

The present invention is therefore addressed to the problem of designing a heat exchanger of the kind generically defined such that, being of a modular type, it can be expanded as desired by the simple connection of several heat exchanger units.

SUMMARY OF THE INVENTION

For the solution of the stated problem, preferably a modular type heat exchanger comprises a dividing wall of meander-like cross section which is bounded by two side covers. Aside from the known advantage that, in such a heat exchanger, the two fluids are unable to mix with one another in the area of the cover, the fact that the transverse channels are open at the sides to which the covers are attached, that the feed channels run between the covers, and that the inlet and outlet openings are disposed at the ends, makes it easily possible to stack several heat exchanger units to increase the heat exchanger capacity. No additional external connections are necessary, because all of the connections are in the headers at the ends. Since furthermore the cross channels of adjacent heat exchanger units will then communicate with one another, the total number of the connecting channels in the headers of stacked heat exchanger units can be reduced. Such a heat exchanger is very compact and, since the feed connections are at the ends, it is very easy to handle. It can be removed from molds bilaterally, and thus it can be made also by pressure casting methods. The heat exchanger according to the invention can be employed in many ways and is especially suitable for cooling motor oil and for the heating of motor vehicles or buses.

It is preferred to place suitable gaskets in the individual joints between the covered sides and the covers; the gaskets are preferably continuous on each covered side, which simplifies handling them. On each of the covered sides the open longitudinal channels need to be surrounded by only a single gasket, since any leakage between the individual longitudinal channels carrying the same fluid will cause no harm.

To prevent even more reliably any mixing of the two fluids on the cover side of the manifold headers, it is preferred to provide outwardly opening outlet channels around the feed channels. As a result, in case of a leak in the area of the headers, the leakage can drain away and will not mix with the other fluid.

In further development, ribs can be provided in the longitudinal channels for at least one of the fluids, and these ribs will promote the exchange of heat between the two fluids.

In further development it may be desirable to dispose the channels through which the two fluids are fed, in a mirror-image relationship to one another on the headers. This will make it possible, for example, to achieve a more uniform flow through all longitudinal channels.

It can furthermore be advantageous to dispose the inlet and outlet openings for each fluid so as to face one cover.

In an especially advantageous embodiment, a plurality of heat exchanger units are stacked to make a heat exchanger of greater capacity. The covers between the adjacent units are eliminated, since the longitudinal channels carrying the same fluid will in that case face and communicate with one another. Also, when the stacking is performed, the corresponding feed channels on the one hand and the transverse channels on the other will be automatically connected to one another. The larger heat exchanger unit is sealed by covers only at the outermost longitudinal sides. This form of construction is extremely compact, highly variable, and easy to handle.

Since, when the heat exchanger units are stacked, the transverse channels carrying the same fluid face and communicate with one another, it is sufficient to connect only the transverse channels carrying one of the fluids in the additional heat exchanger units to the corresponding feeder channels. Thus the total amount of connecting channels can be smaller.

It is furthermore advantageous that only one of the heat exchanger units is connected externally. All other units are automatically connected to one another internally.

To assure the perfect sealing of the heat exchanger, it is preferred to provide suitable gaskets at all of the cover sides of the heat exchanger units.

In one practical embodiment, at least the part of the heat exchanger that is between the covers can be a pressure casting, such as one made of aluminum alloy. The heat exchanger can thus be manufactured both simply and cheaply and be light in weight.

It is especially preferred to make the two sides to which the covers are attached planar and parallel to one another. Thus a very compact, inexpensive and easy-to-handle, plate-like structure results, which can be combined very flexibly to form larger units.

BRIEF DESCRIPTION OF THE DRAWING

The invention will now be explained with the aid of embodiments represented in the drawing, wherein.

Figure 1:
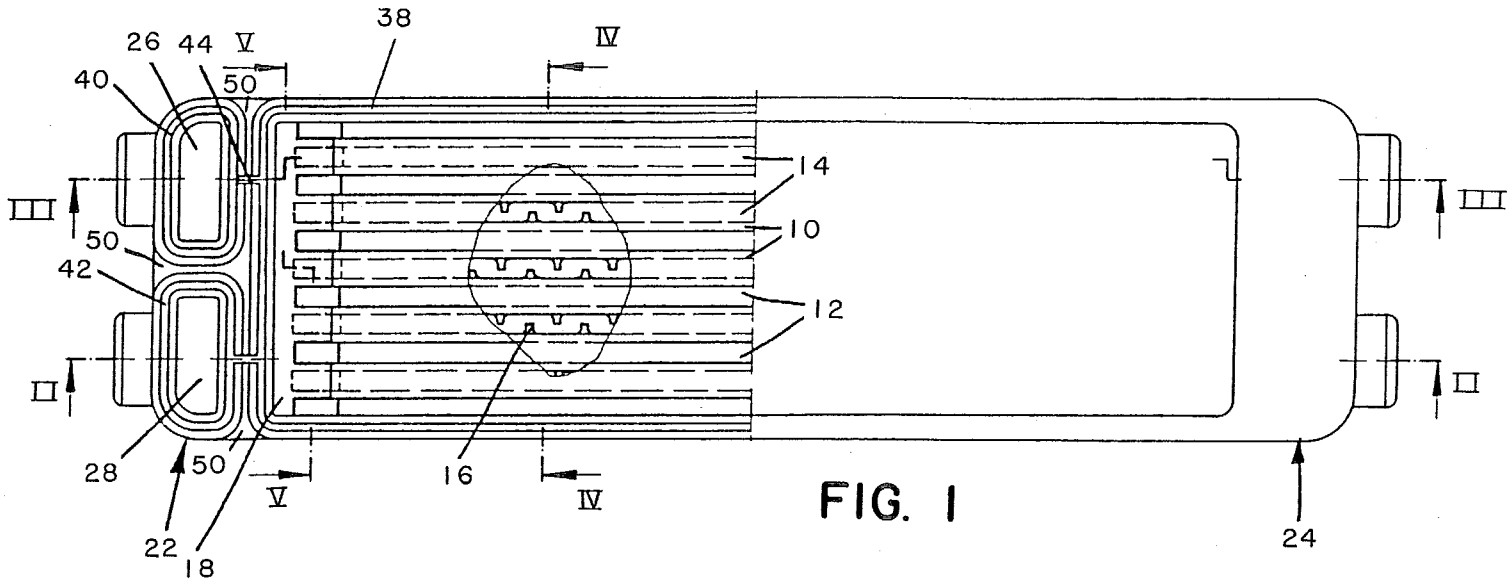
FIG. 1 is a partially cut-away view of a heat exchanger according to the invention.

According to FIGS. 1 to 6, the heat exchanger has in its middle part a dividing wall 10 of a meander-like or zig-zag configuration which defines on opposite longitudinal sides open longitudinal channels 12 for a first fluid and 14 for a second fluid. In the embodiment represented, ribs 16 running perpendicular to the direction of flow are seen in FIG. 1 in the longitudinal channels 14 which serve to carry the oil that is to be cooled by water; these ribs promote the heat exchange that cools the oil. They can also be provided in the other longitudinal channels 12.

Figure 2:
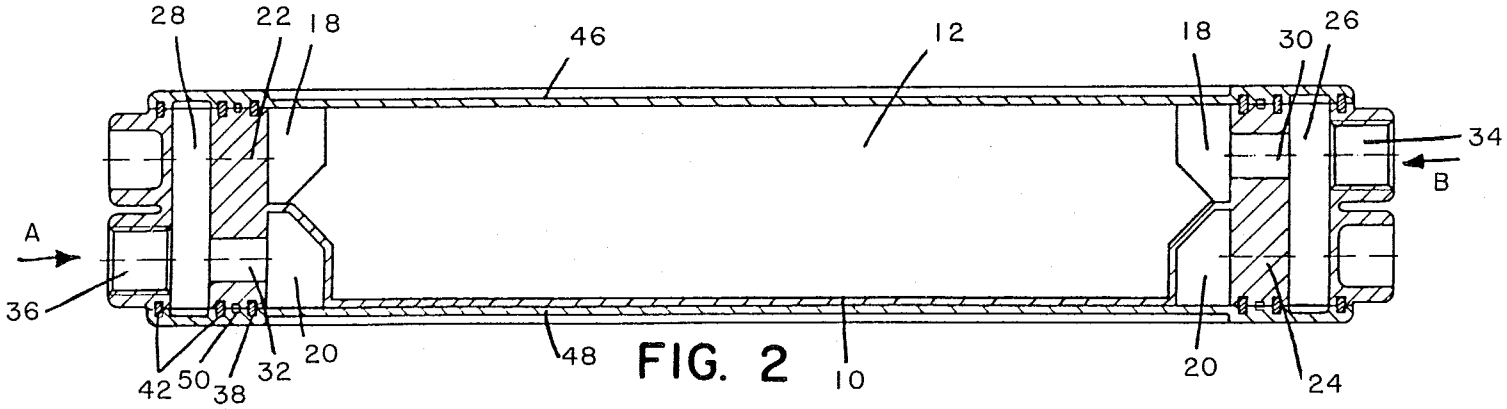
FIG. 2 is a longitudinal section through the heat exchanger along line II—II of FIG. 1.

The longitudinal channels 12 and 14, which are open on the top and bottom sides as seen in FIG. 2, are closed off by top and bottom covers 46 and 48, respectively, which are attached to the top and bottom sides. Any leakage occurring between corresponding longitudinal channels 12 or 14 and the covers 46 or 48 is unimportant, because it cannot cause any mixing of different fluids.

Figure 3:
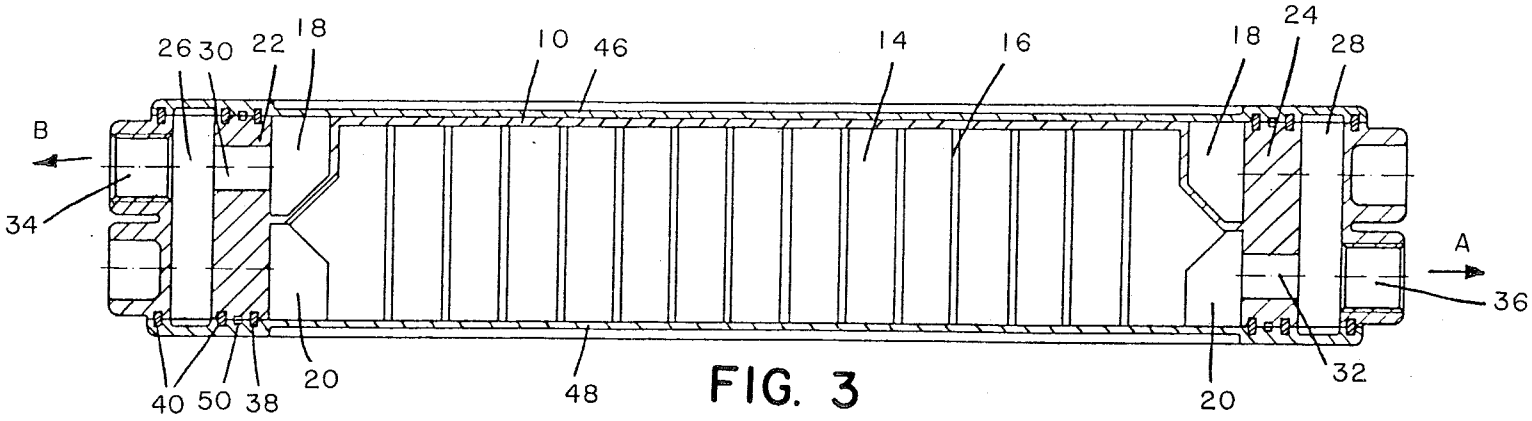
FIG. 3 is a longitudinal section through the heat exchanger along line III—III of FIG. 1.
Figure 6:
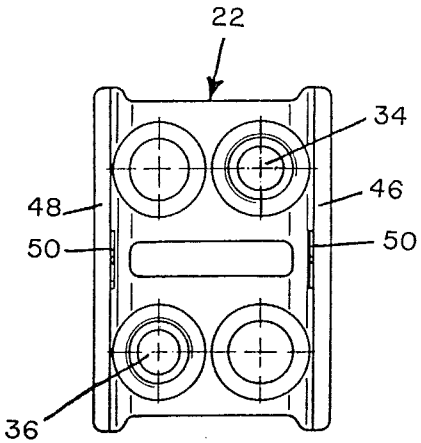
FIG. 6 is a left-end view of the heat exchanger of FIG. 1.
Figure 5:
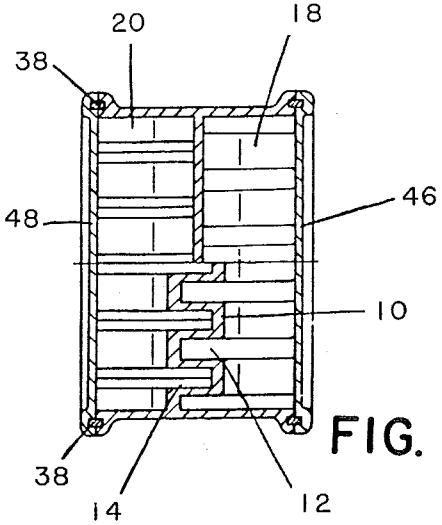
FIG. 5 is a cross section through the heat exchanger along line V-V of FIG. 1.
Figure 4:
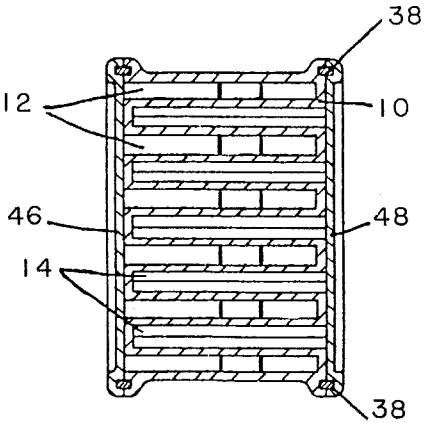
FIG. 4 is a cross section through the heat exchanger along line IV-IV of FIG. 1.

The longitudinal channels 12 and 14 lead at the end into common cross channels 18 and 20. As seen in FIGS. 2, 3 and 5, the latter are adjacent one another at their inner sides, and at their outer sides they are open but covered by the covers 46 and 48. Like the longitudinal channels 12 and 14, the cross channels 18 and 20 which belong together are facing covers 46 and 48, respectively. These cross channels 18 and 20 provide for a uniform distribution of fluid to the individual longitudinal channels 12 and 14.

The heat exchanger has at each end a header 22 and 24, which contains all the feeds. The top and bottom edges of the dividing wall 10, of the laterally open cross channels 18 and 20, and of the headers 22 and 24 are in themselves made planar and parallel to one another.

The top and bottom covers 46 and 48 extend all the way to the end of the headers 22 and 24 entirely covering the top and bottom sides of the heat exchanger.

In each header 22 and 24, two feed channels 26 and 28 disposed transversely side by side extend between the top and bottom sides and the covers 46 and 48. The feed channels 26 are connected on the one hand by connecting channels 30 to the cross channels 18 and on the other hand to inlet and outlet openings 34 at the ends. The feed channels 28 are connected on the one hand through connecting channel 32 to the cross channels 20 and on the other hand to inlet or outlet openings 36 at the ends. As it is shown in FIGS. 2 and 3, the two fluids can flow through the heat exchanger in opposite directions A and B in order to promote the heat exchanger effect.

In the embodiment represented in FIGS. 1 to 6, the feed channels 26 and 28 in the headers 22 and 24 are in a mirror-image relationship to one another. On the other hand, the corresponding inlet or outlet openings 34 and 36 and cross channels 18 and 20 for one fluid each confront one of the covers 46 or 48, respectively. Aside from this special form of construction, other configurations can be chosen, provided that the overall principle of a heat exchanger that can be assembled in a modular manner is preserved. As it can be seen especially from FIGS. 1 to 3, a common outer gasket 38 extends along each longitudinal side of the heat exchanger about the area of the longitudinal channels 12 and 14, respectively. Furthermore, the feed channels 26 and 28 are surrounded on the top and bottom sides by gaskets 40 and 42. On each of these sides, the set of five gaskets 38, 40, 42, can be joined together by strips 44 in order thus to achieve a one-piece gasket. Furthermore, the gaskets 40 and 42 are surrounded by outwardly opening drains on the headers 22 and 24, so that any fluid that leaks out will be drained to the outside and be unable to mix with the other fluid.

Figure 7:
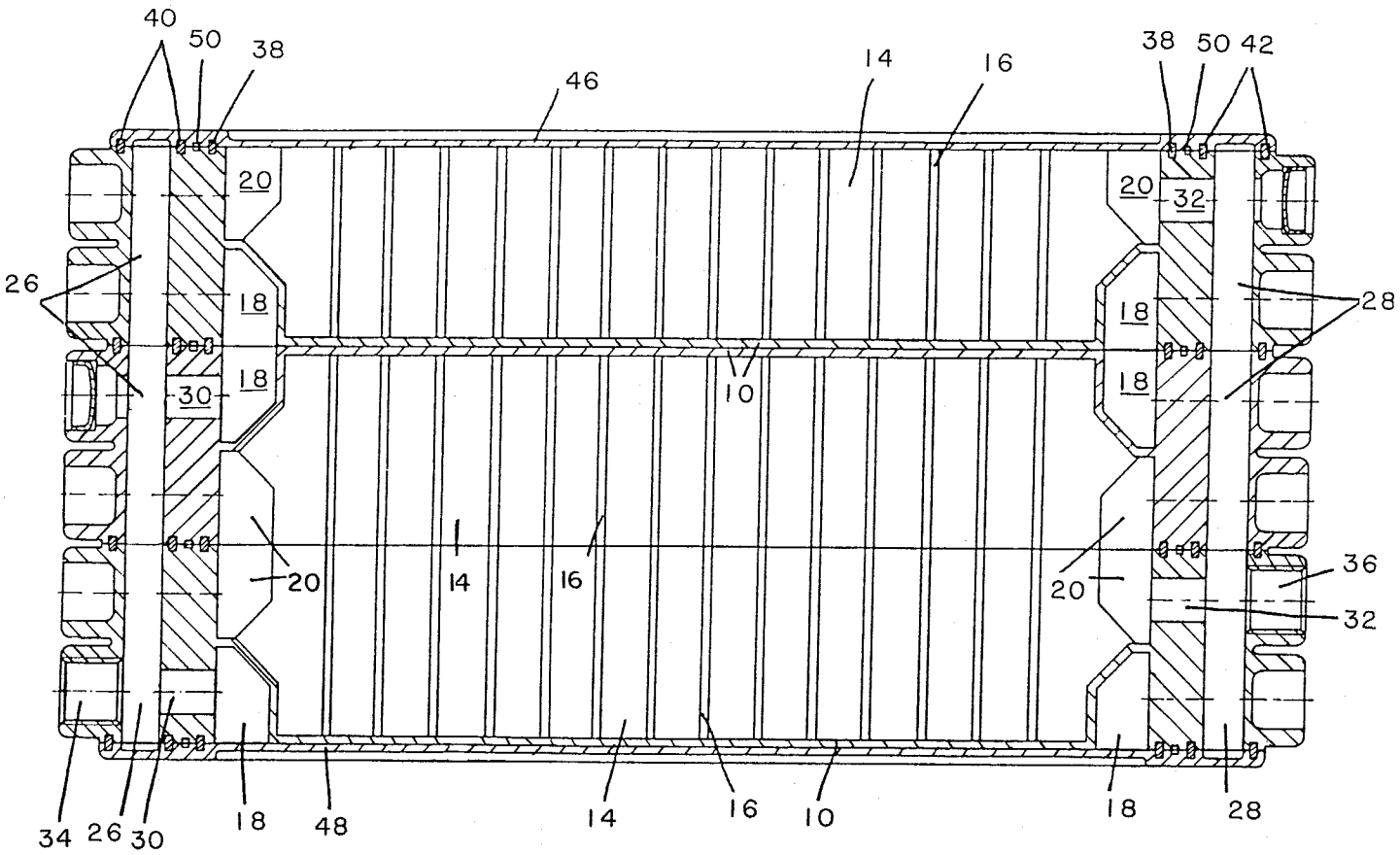
FIG. 7 is a longitudinal cross section through an enlarged heat exchanger consisting of a plurality of stacked heat exchanger units.
Figure 8:
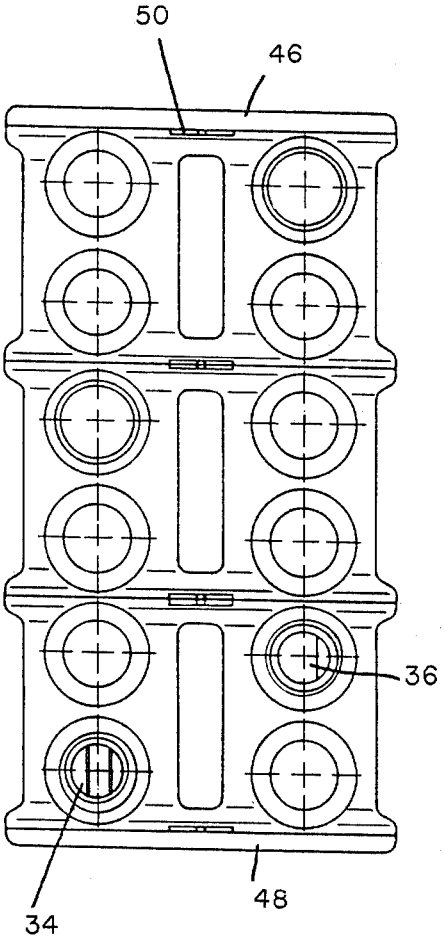
FIG. 8 is a left-end view of the heat exchanger of FIG. 7.

According to the embodiment shown in FIGS. 7 and 8, a plurality of heat exchanger units can be combined by stacking one on the other to form a larger heat exchanger. Then only the outer sides of the outermost heat exchanger units are sealed shut by the covers 46 and 48. Between them the longitudinal channels 12 and 14 of each pair of confronting units will be in alternate communication. The feed channels 26 and 28 in the two headers 22 and 24 are also in communication, so that external connecting lines between the individual units can be eliminated. Only the inlet and outlet openings 34 and 36 of a unit have to be connected externally.

As it can be seen in FIG. 7, after the second heat exchanger unit only the cross channels of one fluid need to be connected to the corresponding feed channels, since the cross channels of the next heat exchanger unit are in communication with them. Thus the total number of feed channels in the headers 22 and 24 is reduced.

The gaskets 38, 40 and 42, and drains 50, are on all of the cover sides of the individual heat exchanger units in order to assure reliable sealing and to prevent any intermixing of the two fluids.

The heat exchanger according to the invention can be made from pressure-cast metal, such as an aluminum alloy, and can be used in many applications, such as an oil cooler for an internal combustion engine, for example. In this case the oil can flow through the ribbed longitudinal channels 14, for example, while the cooling water flows in the opposite direction through the longitudinal channels 12.

It will be understood that the specification and examples are illustrative but not limitative of the present invention in that other embodiments within the spirit and scope of the invention will suggest themselves to those skilled in the art.

What is claimed:

1. A heat exchanger for two fluids, comprising:

a dividing wall of meander-like cross section for defining parallel, longitudinally running longitudinal channels alternately open at opposite longitudinal sides for a flow of two fluids in adjacent longitudinal channels, said channels having two ends;

two covers closing said open longitudinal channels at said opposite longitudinal sides;

two cross channels, situated at both ends of said longitudinal channels, which connect together the longitudinal channels of one fluid on the one hand and of another fluid on the other hand;

connecting channels leading to said cross channels;

two terminal headers of the heat exchanger in its longitudinal direction;

said covers of said longitudinal channels being prolonged to bilaterally cover said two terminal headers;

said two cross channels adjoining one another at their inner sides at the ends of said longitudinal channels and being openable at their opposite outer sides and being closable by said prolonged covers;

in each header, transversely side by side, two feed channels for the two fluids running between said covers and closable thereby;

inlet and outlet openings for said feed channels and disposed at ends of said headers;

each feed channel being connectable by one of said connecting channels to a corresponding cross channel and to a corresponding one of said inlet and outlet openings at the end of the header.

2. A heat exchanger according to claim 1 which includes gaskets which individually surround areas of the longitudinal channels and the feed channels which are openable on longitudinal sides and in which said covers lie at said longitudinal sides on said gaskets.

3. A heat exchanger according to claim 2, which includes gasket grooves and in which said gaskets each are of strung-together construction and are disposed in said gasket grooves.

4. A heat exchanger according to claim 2, which includes outwardly opening drain grooves surrounding said feed channels in the area of the longitudinal sides thereof.

5. A heat exchanger according to claim 1, which includes ribs running transversely of the flow direction in the longitudinal channels of at least one fluid.

6. A heat exchanger according to claim 1, in which said feed channels lie opposite one another in the longitudinal direction of said longitudinal channels and are associated at opposite ends of said longitudinal channels with different groups of said longitudinal channels for the two fluids.

7. A heat exchanger according to claim 1, in which said inlet and outlet openings are for one fluid in each case and adjoin one of said covers in each case.

8. A heat exchanger according to claim 1, which includes a plurality of the heat exchangers stacked one on the other in alternately reversed position without covers being disposed between them, said covers bounding only two outer longitudinal sides of two outer heat exchanger units, at a boundary surface of each two heat exchanger units their feed channels corresponding to one another being joined in alignment with one another, at boundary surfaces of each two heat exchanger units longitudinal channels and cross channels thereof corresponding to the two fluids being alternately joined in alignment with one another.

9. A heat exchanger according to claim 8, in which, beginning with a second heat exchanger unit, in each of said heat exchanger units only cross channels of one of the fluids are connected to corresponding feed channels.

10. A heat exchanger according to claim 8, which includes four inlet and outlet openings connected externally to only one of the heat exchanger units.

11. A heat exchanger according to claim 8, which includes gaskets between adjacent heat-exchanger units and between heat exchanger units and said covers.

12. A heat exchanger according to claim 1, which includes a bilaterally strippable portion disposed between said covers and comprising pressure-cast metal.

13. A heat exchanger according to claim 12, in which said strippable portion comprises an aluminum alloy.

14. A heat exchanger according to claim 1, in which said longitudinal sides in the region of said covers are planar and parallel to one another.

* * * * *